US007820293B2

(12) United States Patent
Dekempeneer

(10) Patent No.: US 7,820,293 B2
(45) Date of Patent: Oct. 26, 2010

(54) SUBSTRATE COATED WITH A LAYERED STRUCTURE COMPRISING A TETRAHEDRAL CARBON COATING

(75) Inventor: Erik Dekempeneer, Oostmalle (BE)

(73) Assignee: NV Bekaert SA, Zwevegem (BE)

( * ) Notice: Subject to any disclaimer, the term of this patent is extended or adjusted under 35 U.S.C. 154(b) by 29 days.

(21) Appl. No.: 12/063,927

(22) PCT Filed: Jul. 13, 2006

(86) PCT No.: PCT/EP2006/064195

§ 371 (c)(1),
(2), (4) Date: May 8, 2008

(87) PCT Pub. No.: WO2007/020138

PCT Pub. Date: Feb. 22, 2007

(65) Prior Publication Data

US 2008/0233425 A1 Sep. 25, 2008

(30) Foreign Application Priority Data

Aug. 18, 2005 (EP) ..... 05107583

(51) Int. Cl.
*B32B 9/00* (2006.01)

(52) U.S. Cl. ..... 428/408; 428/457; 428/469; 428/702

(58) Field of Classification Search ..... 428/408, 428/688, 698, 699, 701, 702
See application file for complete search history.

(56) References Cited

U.S. PATENT DOCUMENTS 6,110,329 A * 8/2000 Holleck et al. ..... 204/192.15
6,143,142 A 11/2000 Shi et al.
6,228,471 B1 5/2001 Neerinck et al.
2004/0074260 A1 4/2004 Veerasamy

FOREIGN PATENT DOCUMENTS

WO WO 00/68455 A1 11/2000
WO WO 2005/054539 A1 6/2005
WO WO 2005/054540 A1 6/2005

(Continued)

OTHER PUBLICATIONS

Sattel, et al., Effects of deposition temperature on the properties of hydrogenated tetrahedral amorphous carbon, Nov. 1, 1997, Journal of Applied Physics, 82, pp. 4566-4576.*

(Continued)

*Primary Examiner*—Timothy M Speer
(74) *Attorney, Agent, or Firm*—Foley & Lardner LLP

(57) ABSTRACT

The invention relates to a metal substrate (11) coated at least partially with a layered structure. The layered structure comprises an intermediate layer (14) deposited on said substrate (11) and a tetrahedral carbon layer (16) deposited on said intermediate layer. The intermediate layer comprises at least one amorphous carbon layer having a Young's modulus lower than 200 GPa and the tetrahedral carbon layer has a Young's modulus higher than 200 GPa. The invention further relates to a method to improve the adhesion of a tetrahedral carbon layer to a substrate and to a method to bridge the gap in Young's modulus of the metal substrate and the Young's modulus of a tetrahedral carbon coating deposited on said metal substrate.

17 Claims, 1 Drawing Sheet

FOREIGN PATENT DOCUMENTS

WO WO 2006/021275 A1 3/2006

OTHER PUBLICATIONS

Logothetidis, et al., A new process for the development of hard and stable sputtered amorphous carbon films, No month 1999, 53, p. 61-65.*

Wang et al., Characterization of metal-containing amorphous hydrogenated carbon films, Mar. 3, 1992, Journal of Materials Research, 7, p. 667-675.*

D. Neerinck et al., "Tribological properties and structural investigation of Diamond-Like Nanocomposites", Supplement Le Vide Science technique et applications, No. 279 (1996), pp. 67-69.

Alfred Grill, "Diamond-like carbon: state of the art", Diamond and Related Materials, vol. 8 (1999), pp. 428-434.

* cited by examiner

SUBSTRATE COATED WITH A LAYERED STRUCTURE COMPRISING A TETRAHEDRAL CARBON COATING

FIELD OF THE INVENTION

The invention relates to a metal substrate coated with a layered structure comprising an intermediate layer deposited on the substrate and a tetrahedral carbon layer deposited on the intermediate layer. The intermediate layer comprises an amorphous carbon layer.

BACKGROUND OF THE INVENTION

The term Diamond Like Carbon (DLC) describes a group of materials comprising carbon with structures and properties resembling that of diamond. Some examples of Diamond Like Carbon coatings are a-C, a-C:H, i-C, ta-C and ta-C:H coatings.

As DLC has many attractive properties including high hardness, chemical inertness, high thermal conductivity, good electrical and optical properties, biocompatibility and excellent tribological behavior, DLC has attracted a considerable interest as coating material.

A rough classification of DLC coatings is given by the fractions of $sp^3$ bonding. Tetrahedral carbon coatings have a high fraction of $sp^3$ bonded carbon, whereas amorphous carbon such as a-C or a-C:H coatings have a lower fraction of $sp^3$ bonding and a higher fraction of $sp^2$ bonding.

A second classification is given by the hydrogen content. The DLC coatings can be classified in non-hydrogenated coatings (ta-C and a-C) and hydrogenated coatings (ta-C:H and a-C:H).

The group of tetrahedral carbon coatings shows many interesting properties like a high hardness (resembling the hardness of diamond) and a high Young's modulus. These properties make tetrahedral carbon coatings ideal for many challenging wear-resistant applications. However, as the compressive stress is proportional to the $sp^3$ bonding, the compressive stress in tetrahedral carbon coatings is high.

The large compressive stress in the coating limits the adhesion of the coating to the substrate and limits the overall film thickness of the coating.

SUMMARY OF THE INVENTION

It is an object of the present invention to avoid the drawbacks of the prior art.

It is another object of the present invention to provide a metal substrate coated with a layered structure comprising a hard tetrahedral carbon layer and having a good adhesion to the metal substrate.

It is a further object to provide a metal substrate coated with a layered structure comprising an intermediate layer and a tetrahedral carbon layer whereby the intermediate layer is bridging the gap in Young's modulus between the metal substrate and the tetrahedral carbon layer.

According to a first aspect of the present invention a metal substrate coated at least partially with a layered structure is provided. The layered structure comprises an intermediate layer and a tetrahedral carbon layer. The intermediate layer is deposited on the substrate, the tetrahedral carbon layer is deposited on the intermediate layer.

The intermediate layer comprises at least one amorphous carbon layer having a Young's modulus lower than 200 GPa and the tetrahedral carbon layer has a Young's modulus higher than 200 GPa.

The layered structure may comprise a number of periods, each period comprising an intermediate layer comprising at least one amorphous carbon layer having a Young's modulus lower than 200 GPa and a tetrahedral carbon layer having a Young's modulus higher than 200 GPa. The number of periods may range between 2 and 100 and is for example between 2 and 30, as for example 10 or 15.

Tetrahedral Carbon Layer

The tetrahedral carbon layer has a Young's modulus preferably ranging between 200 and 800 GPa. More preferably, the tetrahedral carbon layer has a Young's modulus of at least 300 GPa, as for example 400 GPa, 500 GPa or 600 GPa.

The hardness of the tetrahedral carbon layer is preferably higher than 20 GPa. The preferred range for the hardness of the tetrahedral carbon layer is between 20 GPa and 80 GPa. More preferably, the hardness of the tetrahedral carbon layer is at least 30 GPa, as for example 40 GPa, 50 GPa or 60 GPa.

The fraction of $sp^3$ bonded carbon of tetrahedral carbon is preferably higher than 50% as for example between 50% and 90%, such as 80%.

The tetrahedral carbon layer may comprise non-hydrogenated tetrahedral carbon (ta-C) or hydrogenated tetrahedral carbon (ta-C:H). In case of hydrogenated tetrahedral carbon, the hydrogen concentration is preferably lower than 20 at %, as for example 10 at %.

A preferred tetrahedral carbon layer comprises non-hydrogenated tetrahedral carbon (ta-C) having a high fraction of $sp^3$ bonded carbon, such as a fraction of $sp^3$ bonded carbon of 80%.

The tetrahedral carbon layer can be deposited by a number of different techniques.

Preferred deposition techniques comprise ion beam deposition, pulsed laser deposition, arc deposition, such as filtered or non-filtered arc deposition, chemical vapor deposition, such as enhanced plasma assisted chemical vapor deposition and laser arc deposition.

To influence the properties as for example the electrical conductivity of the layered structure according to the present invention, the tetrahedral carbon layer can be doped with a metal. In principle any metal can be considered as dopant.

Preferably, the dopant comprises one or more transition metal such as Ti, Zr, Hf, V, Nb, Ta, Cr, Mo, W, Mn, Re, Fe, Co, Ir, Ni, Pd and Pt.

Other dopants may comprise B, Li, Na, Si, Ge, Te, O, Mg, Cu, Al, Ag and Au.

Preferred dopants are W, Zr and Ti.

The tetrahedral carbon layer preferably has a thickness higher than 0.5 μm, for example 1 μm.

Amorphous Carbon Layer

The amorphous carbon layer has a Young's modulus lower than 200 GPa.

The amorphous carbon layer may comprise an amorphous hydrogenated carbon (a-C:H) layer or a diamond like nanocomposite (DLN) layer.

The amorphous hydrogenated carbon layer (a-C:H) preferably has a fraction of $sp^3$ bonded carbon lower than 40%. More preferably, the fraction of $sp^3$ bonded carbon is lower than 30%.

The hydrogen content is preferably between 20 and 40%, for example 30%.

The hardness of the amorphous hydrogenated carbon layer (a-C:H) is preferably between 15 GPa and 25 GPa. More preferably, the hardness of the amorphous hydrogenated carbon layer (a-C:H) is between 18 GPa and 25 GPa.

A diamond like nanocomposite (DLN) layer comprises an amorphous structure of C, H, Si and O. Generally, diamond like nanocomposite coatings comprise two interpenetrating networks a-C:H and a-Si:O. Diamond like nanocomposite coatings are commercially known as DYLYN® coatings.

The hardness of a diamond like nanocomposite layer is preferably between 10 GPa and 20 GPa.

Preferably, the nanocomposite composition comprises in proportion to the sum of C, Si, and O: 40 to 90 at % C, 5 to 40 at % Si, and 5 to 25 at % O.

Preferably, the diamond-like nanocomposite composition comprises two interpenetrating networks of a-C:H and a-Si:O.

The amorphous carbon layer (a-C:H layer or DLN layer) may further be doped with a metal, such as a transition metal as for example Ti, Zr, Hf, V, Nb, Ta, Cr, Mo, W, Mn, Re, Fe, Co, Ir, Ni, Pd and Pt.

Other dopants may comprise B, Li, Na, Si, Ge, Te, O, Mg, Cu, Al, Ag and Au.

Preferred dopants are W, Zr and Ti.

The amorphous carbon layer preferably has a thickness higher than 0.5 μm as for example higher than 1 μm.

The thickness of the layered structure is preferably higher than 0.5 μm or higher than 1 μm, as for example 2 μm or 3 μm.

Substrate

The substrate may comprise any metal substrate, either flexible or rigid. Examples of substrates comprise steel substrates, hard metal substrates, aluminium or aluminium alloy substrates, titanium or titanium alloy substrates or copper and copper alloy substrates. The layered coating according to the present invention is in particular suitable to be applied on valve train components such as tappets, wrist pins, fingers, finger followers, camshafts, rocker arms, pistons, piston rings, gears, valves, valve springs and lifters.

Adhesion Promoting Layer

To further increase the adhesion of the tetrahedral carbon layer to the metal substrate and/or of the layered structure to the metal substrate, an additional adhesion promoting layer can be deposited on the metal substrate before the deposition of the intermediate layer.

The adhesion promoting layer may comprise any metal.

Preferably, the adhesion promoting comprises at least one element of the group consisting of silicon and the elements of group IVB, the elements of group VB and the elements of Group VIB of the periodic table.

Preferred intermediate layers comprise Ti and/or Cr.

Possibly, the adhesion promoting layer comprises more than one layer, for example two or more metal layers, each layer comprising a metal selected from the group consisting of silicon, the elements of group IVB, the elements of group VB and the elements of group VIB of the periodic table, as for example a Ti or Cr layer.

Alternatively, the adhesion promoting layer may comprise one or more layers of a carbide, a nitride, a carbonitride, an oxycarbide, an oxynitride, an oxycarbonitride of a metal selected from the group consisting of silicon, the elements of group IVB, the elements of group VB and the elements of group VIB of the periodic table.

Some examples are TiN, CrN, TiC, $Cr_2C_3$, TiON, TiCN and CrCN.

Furthermore, the adhesion promoting layer may comprise any combination of one or more metal layers of a metal selected from the group consisting of silicon, the elements of group IVB, the elements of group VB and the elements of group VIB of the periodic table and one or more layers of a carbide, a nitride, a carbonitride, an oxycarbide, an oxynitride, an oxycarbonitride of a metal selected from the group consisting of silicon, the elements of group IVB, the elements of group VB and the elements of group VIB of the periodic table.

Some examples of intermediate layers comprise the combination of a metal layer and a metal carbide, the combination of a metal layer and a metal nitride, the combination of a metal layer and a metal carbonitride, the combination of a metal layer, a metal carbide layer and a metal layer and the combination of a metal layer, a metal nitride layer and a metal layer.

The thickness of the adhesion promoting layer is preferably between 1 nm and 1000 nm as for example between 10 and 500 nm.

The adhesion promoting layer can be deposited by any technique known in the art as for example by physical vapor deposition such as sputtering or by evaporation.

Top Layer

According to another embodiment of the present invention, the layered structure may further comprise a top layer deposited on the tetrahedral carbon layer.

The top layer of the layered structure may be chosen in function of the desired properties of the layered structure one wants to obtain and depending on the application.

As tetrahedral carbon coatings have a high hardness and a high roughness, they may cause an increased wear rate of the counterbody. Therefore, it can be desired to deposit a top coating having a low roughness on top of the tetrahedral carbon coatings. This top layer can positively influence the running-in wear behaviour of a tetrahedral carbon coating.

Examples of top layers comprise an amorphous hydrogenated carbon (a-C:H) layer, a diamond like nanocomposite (DLN) layer, an amorphous hydrogenated carbon layer (a-C:H) doped with one or more of the elements O, N and/or F, a diamond like nanocomposite (DLN) layer doped with one or more o the elements O, N and/or F, a metal doped hydrogenated carbon layer or a metal doped diamond like nanocomposite layer.

When an amorphous hydrogenated carbon (a-C:H) layer is deposited on top of the layered structure, the hardness and low-wear characteristics typical for such a layer will prevail.

When a diamond like nanocomposite (DLN) layer is deposited as top layer, the layered structure is characterized by a low surface energy and by a low friction coefficient. Such a layered structure is in particular suitable as non-sticking coating.

A preferred embodiment of a layered structure deposited on a metal substrate according to the present invention comprises an amorphous carbon layer (such as a-C:H) deposited on a metal substrate, a diamond like nanocomposite (DLN) deposited on top of this amorphous carbon layer and a tetrahedral carbon layer deposited on top of this diamond like nanocomposite (DLN).

The layered structure may also comprise a number of periods, each period comprising an amorphous carbon layer (such as a-C:H), a diamond like nanocomposite (DLN) layer and a tetrahedral carbon layer.

The number of periods may range between 2 and 100 and is for example between 2 and 30, as for example 10 or 15.

The layered structure according to the present invention comprising an intermediate layer having a Young's modulus lower than 200 GPa and a tetrahedral carbon layer deposited on this intermediate layer is in particular suitable as coating for components to be used in lubricated conditions such as valve train components.

According to a second aspect of the present invention, a method to improve the adhesion of a tetrahedral carbon layer to a substrate is provided.

The method comprises the application of an amorphous carbon layer having a Young's modulus lower than 200 GPa before the deposition of the tetrahedral carbon layer.

According to a third aspect of the invention, a method to bridge the gap in Young's modulus of the metal substrate and the Young's modulus of a tetrahedral carbon coating deposited on the metal substrate is provided.

The method comprises the application of an intermediate layer on the metal substrate before the deposition of the tetrahedral carbon layer. The intermediate layer comprises at least one amorphous carbon layer having a Young's modulus lower than the Young's modulus of the tetrahedral carbon layer. Preferably, the intermediate layer has a Young's modulus higher than the Young's modulus of the metal substrate but lower than the Young's modulus of the tetrahedral carbon layer.

The Young's modulus of the intermediate layer is preferably between 100 and 200 GPa, as for example 150 GPa or 170 GPa; whereas the Young's modulus of the tetrahedral carbon layer is preferably between 200 and 800 GPa.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
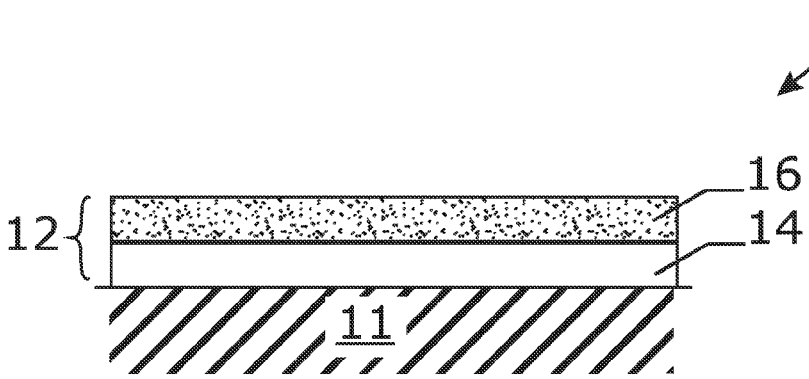
FIGS. 1 to 3 show in cross-section different embodiments of layered structures according to the present invention.

FIG. 1 gives a cross-section of a first embodiment of a coated metal substrate 10 according to the present invention. A substrate 11 is coated with a layered structure 12.

The layered structure comprises an intermediate layer 14 deposited on the metal substrate 10. The intermediate layer 14 comprises an amorphous hydrogenated carbon layer, a-C:H.

a tetrahedral carbon layer 16 deposited on the intermediate layer 14.

The intermediate layer 14 has a thickness of 1 μm and a Young's modulus of 170 GPa.

The tetrahedral carbon layer 16 has a thickness of 1 μm and a Young's modulus of 400 GPa.

In an alternative embodiment of the present invention, the intermediate layer 14 comprises a diamond-like nanocomposite layer comprising two interpenetrating networks a-C:H and a-Si:O.

This intermediate layer 14 has a thickness of 1 μm and a Young's modulus of 150 GPa.

Figure 2:
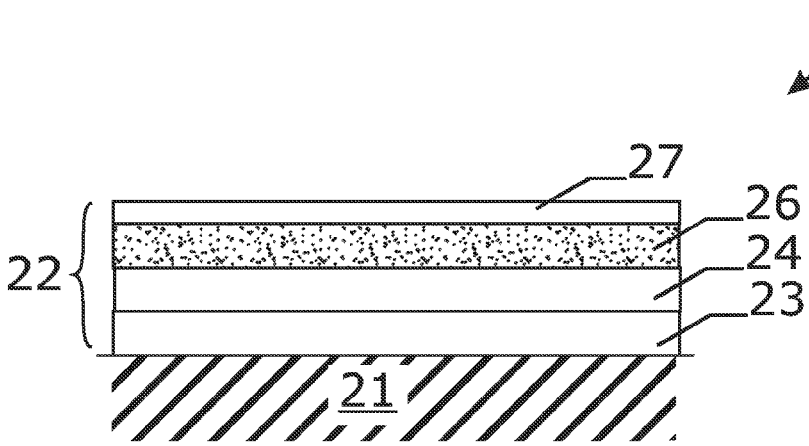

FIG. 2 shows the cross-section of a second embodiment of a coated substrate 20 according to the present invention. A metal substrate 21 is coated with a layered structure 22.

The layered structure comprises an adhesion promoting layer 23 deposited on the metal substrate. The adhesion promoting layer 23 comprises for example a chromium or chromium based layer or a titanium or titanium based layer;

an intermediate layer 24 deposited on the adhesion promoting layer 23. The intermediate layer 24 comprises an amorphous carbon layer;

a tetrahedral carbon layer 26 deposited on the intermediate layer 24.

The adhesion promoting layer 23 has a thickness of 0.2 μm; the intermediate layer 24 has a thickness of 1 μm and a Young's modulus of 170 GPa and the tetrahedral carbon layer 26 has a thickness of 1 μm and a Young's modulus of 400 GPa.

Possibly, the layered structure 22 further comprises a top layer 27 deposited on the tetrahedral carbon layer 26. The top layer 27 comprises for example a diamond-like nanocomposite layer comprising two interpenetrating networks of a-C:H and a-S:O. The top layer 27 has for example a thickness of 0.1 μm and a Young's modulus of 150 GPa.

For a person skilled in the art it is clear that alternative embodiments can be considered comprising either an adhesion promoting layer or a top layer.

Figure 3:
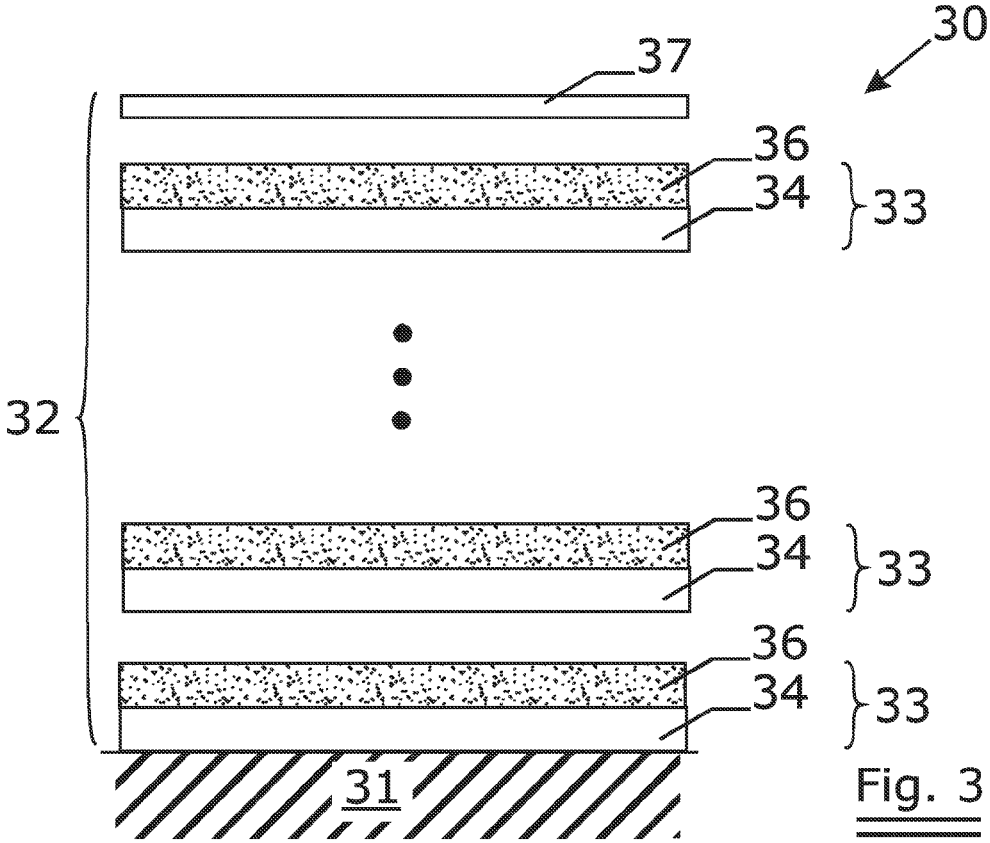

FIG. 3 shows the cross-section of a third embodiment of a coated substrate 30 according to the present invention.

A metal substrate 31 is coated with a layered structure 32 comprising a number of periods 33. Each period comprises an intermediate layer 34 and a tetrahedral carbon layer 36. The number of periods is for example 10.

Possibly, the layered structure 32 further comprises a top layer 37.

The invention claimed is:

1. A metal substrate coated at least partially with a layered structure, said layered structure comprising:

an intermediate layer deposited on said substrate and a tetrahedral carbon layer deposited on said intermediate layer, wherein said intermediate layer comprises at least one amorphous carbon layer having a Young's modulus lower than 200 GPa, and wherein said tetrahedral carbon layer is a non-hydrogenated tetrahedral carbon layer having a Young's modulus higher than 200 GPa.

2. A substrate according to claim 1, wherein said layered structure comprises a number of periods, wherein each period comprises an intermediate layer comprising at least one amorphous carbon layer having a Young's modulus lower than 200 GPa and a non-hydrogenated tetrahedral carbon layer having a Young's modulus higher than 200 GPa, and wherein said number of periods is between 2 and 100.

3. A substrate according to claim 1, wherein said tetrahedral carbon layer has a Young's modulus ranging between 200 and 800 GPa.

4. A substrate according to claim 1, wherein said tetrahedral carbon layer has a hardness higher than 20 GPa.

5. A substrate according to claim 1, wherein said tetrahedral carbon layer has a fraction of $sp^3$ bonded carbon higher than 30%.

6. A substrate according to claim 1, wherein said tetrahedral carbon layer has a fraction of $sp^3$ bonded carbon higher than 80%.

7. A substrate according to claim 1, wherein said tetrahedral carbon layer is doped with a metal.

8. A substrate according to claim 1, wherein said amorphous carbon layer is selected from the group consisting of amorphous hydrogenated carbon (a-C:H) provided with Si and O and amorphous hydrogenated carbon (a-C:H).

9. A substrate according to claim 8, wherein said amorphous carbon layer provided with Si and O comprises a first interpenetrating network of predominantly $sp^3$ bonded carbon in a diamond-like carbon network stabilized by hydrogen, and a second interpenetrating network of silicon stabilized by oxygen.

10. A substrate according to claim 1, wherein said amorphous carbon layer is doped with at least one metal.

11. A substrate according to claim 1, wherein said layered structure further comprises an adhesion promoting layer deposited on said substrate before deposition of said intermediate layer.

12. A substrate according to claim 11, wherein said adhesion promoting layer comprises at least one layer, wherein said at least one layer comprises at least one element of the group consisting of silicon, an element from group IVB of the periodic table, an element from group VB of the periodic table, and an element from group VIB of the periodic table.

13. A substrate according to claim 11, wherein said adhesion promoting layer comprises at least one metal layer, said at least one metal layer comprising at least one element of the group consisting of silicon, an element from group IVB of the periodic table, an element from group VB of the periodic table, and an element from group VIB of the periodic table.

14. A substrate according to claim 11, wherein said adhesion promoting layer comprises at least one layer selected from form the group consisting of carbides, nitrides, carbonitrides, oxycarbides, oxynitrides, oxycarbonitrides of at least one element of the group consisting of silicon, an element from group IVB of the periodic table, an element from group VB of the periodic table, and an element from group VIB of the periodic table.

15. A substrate according to claim 11, wherein said adhesion promoting layer comprises a combination of at least one metal layer of a metal selected from the group consisting of silicon, an element from group IVB of the periodic table, an element from group VB of the periodic table, and an element from group VIB of the periodic table and at least one layer of a carbide, a nitride, a carbonitride, an oxycarbide, an oxynitride, an oxycarbonitride of a metal selected from the group consisting of silicon, an element from group IVB of the periodic table, an element from group VB of the periodic table, and an element from group VIB of the periodic table.

16. A substrate according to claim 1, wherein said layered structure further comprises a top layer, and wherein said top layer is deposited on said tetrahedral carbon layer.

17. A substrate according to claim 16, wherein said top layer is selected from the group consisting of amorphous hydrogenated carbon (a-C:H); amorphous hydrogenated carbon (a-C:H) doped with one or more of elements O, N and/or F; amorphous hydrogenated carbon (a-C:H) provided with Si and O and being metal doped or doped with one or more of the elements O, N and/or F; and metal doped hydrogenated carbon.

* * * * *